US010254701B2

(12) United States Patent
Tsunoda

(10) Patent No.: US 10,254,701 B2
(45) Date of Patent: Apr. 9, 2019

(54) PAPER CORRECTION APPARATUS, IMAGE FORMING SYSTEM AND NON-TRANSITORY COMPUTER READABLE MEDIUM ON WHICH PAPER CORRECTION PROGRAM IS RECORDED

(71) Applicant: KONICA MINOLTA, INC., Chiyoda-ku, Tokyo (JP)

(72) Inventor: Akira Tsunoda, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/454,427

(22) Filed: Mar. 9, 2017

(65) Prior Publication Data

US 2017/0261908 A1 Sep. 14, 2017

(30) Foreign Application Priority Data

Mar. 10, 2016 (JP) ..... 2016-046848

(51) Int. Cl.
*G03G 15/00* (2006.01)
*B65H 29/70* (2006.01)

(52) U.S. Cl.
CPC ..... *G03G 15/6576* (2013.01); *B65H 29/70* (2013.01); *B65H 2301/51256* (2013.01); *B65H 2404/262* (2013.01); *G03G 2215/00662* (2013.01); *G03G 2215/0135* (2013.01); *G03G 2221/1696* (2013.01)

(58) Field of Classification Search
CPC .. B65H 2301/5121; B65H 2301/51212; B65H 2301/5125; B65H 2301/51256; G03G 15/6576; G03G 2215/00662
See application file for complete search history.

(56) References Cited

U.S. PATENT DOCUMENTS

2009/0003912 A1* 1/2009 Nagasaki ..... G03G 15/6576 399/406

FOREIGN PATENT DOCUMENTS

JP 2003137467 A 5/2003
JP 2013028434 A 2/2013

OTHER PUBLICATIONS

SIPO First Office Action for corresponding CN Application No. 201710137040A; dated Jun. 28, 2018.
SIPO Search Report for corresponding CN Application No. 201710137040.4; dated Jun. 28, 2018.

* cited by examiner

*Primary Examiner* — Michael C McCullough
(74) *Attorney, Agent, or Firm* — Cantor Colburn LLP

(57) ABSTRACT

A paper correction apparatus B corrects a curl of a sheet S by passing the sheet S through curved paper conveying routes CCP1 and CCP2 whose curving amounts can be changed. The paper correction apparatus B is provided with a control unit B3 which sets the curving amounts of the curved paper conveying routes CCP1 and CCP2, and changes a sheet interval in accordance with the curving amounts which are set. By this configuration, it is possible to inhibit the productivity from being reduced due to paper correction during performing post-printing processes in a finisher which is located in the downstream side of the paper correction apparatus B.

17 Claims, 10 Drawing Sheets

Fig. 5

| CURL ADJUST-MENT VALUE | PAPER TYPE | COATED PAPER | | | | OTHER PAPER | | | |
|---|---|---|---|---|---|---|---|---|---|
| | PAPER DENSITY | 40～91 | 92～176 | 177～256 | 257～ | 40～91 | 92～176 | 177～256 | 257～ |
| | PAPER SIZE | ALL SIZES | | | | | | | |
| +16 | — | 1 | 4 | 9 | 12 | 1 | 4 | 9 | 12 |
| +15 | — | 2 | 5 | 10 | 12 | 2 | 5 | 10 | 12 |
| +14 | — | 3 | 6 | 10 | 13 | 3 | 6 | 10 | 13 |
| +13 | — | 4 | 7 | 11 | 13 | 4 | 7 | 11 | 13 |
| +12 | — | 5 | 8 | 12 | 14 | 5 | 8 | 12 | 14 |
| +11 | — | 6 | 9 | 12 | 14 | 6 | 9 | 12 | 14 |
| +10 | — | 7 | 10 | 13 | 15 | 7 | 10 | 13 | 15 |
| +9 | — | 8 | 11 | 14 | 15 | 8 | 11 | 14 | 15 |
| +8 | — | 9 | 12 | 14 | 16 | 9 | 12 | 14 | 16 |
| +7 | — | 10 | 13 | 15 | 16 | 10 | 13 | 15 | 16 |
| +6 | — | 11 | 14 | 16 | 17 | 11 | 14 | 16 | 17 |
| +5 | — | 12 | 15 | 16 | 17 | 12 | 15 | 16 | 17 |
| ⋮ | ⋮ | ⋮ | ⋮ | ⋮ | ⋮ | ⋮ | ⋮ | ⋮ | ⋮ |
| −5 | — | 28 | 25 | 24 | 23 | 28 | 25 | 24 | 23 |
| −6 | — | 29 | 26 | 24 | 23 | 29 | 26 | 24 | 23 |
| −7 | — | 30 | 27 | 25 | 24 | 30 | 27 | 25 | 24 |
| −8 | — | 31 | 28 | 26 | 24 | 31 | 28 | 26 | 24 |
| −9 | — | 32 | 29 | 26 | 25 | 32 | 29 | 26 | 25 |
| −10 | — | 33 | 30 | 27 | 25 | 33 | 30 | 27 | 25 |
| −11 | — | 34 | 31 | 28 | 26 | 34 | 31 | 28 | 26 |
| −12 | — | 35 | 32 | 28 | 26 | 35 | 32 | 28 | 26 |
| −13 | — | 36 | 33 | 29 | 27 | 36 | 33 | 29 | 27 |
| −14 | — | 37 | 34 | 30 | 27 | 37 | 34 | 30 | 27 |
| −15 | — | 38 | 35 | 30 | 28 | 38 | 35 | 30 | 28 |
| −16 | — | 39 | 36 | 31 | 28 | 39 | 36 | 31 | 28 |

Fig. 6

| CONTROL PATTERN | IRONING ANGLE TARGET VALUE (°) | | THE NUMBER OF MOTOR PULSES (STEPS) | | CONVEYING LENGTH ADJUSTMENT VALUE (mm) | |
|---|---|---|---|---|---|---|
| | FIRST | SECOND | FIRST | SECOND | FIRST | SECOND |
| 1 | 140 | 12 | 155 | 3 | 30.8 | 0 |
| 2 | 132 | | 145 | | 26.4 | |
| 3 | 124 | | 137 | | 23.5 | |
| 4 | 116 | | 130 | | 21.3 | |
| 5 | 108 | | 123 | | 19.7 | |
| 6 | 100 | | 116 | | 18.4 | |
| 7 | 92 | | 107 | | 15.3 | |
| 8 | 84 | | 98 | | 13.4 | |
| 9 | 78 | | 90 | | 11.5 | |
| 10 | 72 | | 83 | | 9.9 | |
| 11 | 66 | | 76 | | 8.4 | |
| 12 | 60 | | 69 | | 7.1 | |
| ⋮ | ⋮ | | ⋮ | ⋮ | ⋮ | ⋮ |
| 28 | 12 | 60 | 3 | 69 | 0 | 7.1 |
| 29 | | 66 | | 76 | | 8.4 |
| 30 | | 72 | | 83 | | 9.9 |
| 31 | | 78 | | 90 | | 11.5 |
| 32 | | 84 | | 98 | | 13.4 |
| 33 | | 92 | | 107 | | 15.3 |
| 34 | | 100 | | 116 | | 18.4 |
| 35 | | 108 | | 123 | | 19.7 |
| 36 | | 116 | | 130 | | 21.3 |
| 37 | | 124 | | 137 | | 23.5 |
| 38 | | 132 | | 145 | | 26.4 |
| 39 | | 140 | | 155 | | 30.8 |

Fig. 7

CONTROL PATTERN 1

| CONTROL PATTERN AFTER CHANGE | DIFFERENTIAL CONVEYING LENGTH (mm) | | CONTINUATION TIME VARIATION (s) AT 1600mm/s |
|---|---|---|---|
| | 1ST | 2ND | |
| 2 | −4.4 | | $-\alpha 1$ |
| 3 | −7.3 | | $-\alpha 2$ |
| 4 | −9.5 | | $-\alpha 3$ |
| 5 | −11.1 | | $-\alpha 4$ |
| 6 | −12.4 | | $-\alpha 5$ |
| 7 | −15.5 | 0 | $-\alpha 6$ |
| ⋮ | ⋮ | | ⋮ |

Fig. 8

CONTROL PATTERN 27

| CONTROL PATTERN AFTER CHANGE | DIFFERENTIAL CONVEYING LENGTH (mm) | | CONTINUATION TIME VARIATION (s) AT 1600mm/s |
|---|---|---|---|
| | 1ST | 2ND | |
| 1 | +30.8 | | $+\beta 1$ |
| 2 | +26.4 | | $+\beta 2$ |
| 3 | +23.5 | | $+\beta 3$ |
| 4 | +21.3 | | $+\beta 4$ |
| 5 | +19.7 | | $+\beta 5$ |
| 6 | +18.4 | −5.9 | $+\beta 6$ |
| ⋮ | ⋮ | | ⋮ |

PAPER CORRECTION APPARATUS, IMAGE FORMING SYSTEM AND NON-TRANSITORY COMPUTER READABLE MEDIUM ON WHICH PAPER CORRECTION PROGRAM IS RECORDED

CROSS-REFERENCE TO RELATED APPLICATIONS

The present application claims priority under 35 U.S.C. § 119 to Japanese Patent Application No. 2016-046848, filed Mar. 10, 2016. The contents of this application are herein incorporated by reference in their entirety.

BACKGROUND OF THE INVENTION

Field of Invention

The present invention relates to a paper correction apparatus, an image forming system, a non-transitory computer readable medium on which a paper correction program is recorded.

Description of Related Art

Heretofore, a paper correction apparatus is known which intervenes between an image forming apparatus and a finisher in order to correct a curl of a sheet for preventing troubles due to the curl of the sheet from occurring in the finisher located in the subsequent stage. This type of the paper correction apparatus corrects a curl of a sheet by making use of a paper conveying route which is curved in the reverse direction to the curl direction (the protruding direction of the curling sheet) to correct the curl of the sheet. Specifically speaking, a paper correction mechanism is constructed by a conveyor belt, which comes in contact with one side of a sheet, and a cylindrical shaft member which extends in the width direction of the conveyor belt in the other side of the sheet to form a curved paper conveying route for correcting the sheet by pushing the cylindrical shaft member into the conveyor belt (for example, refer to Japanese Patent Published Application No. 2003-137467).

However, when this paper correction apparatus corrects a warped sheet, the stronger the paper correction is, the greater the degree of the curve of the conveyor belt has to be so that the paper conveying length becomes longer. The timing of supplying a sheet to the subsequent finisher can therefore differ depending upon a curl correcting force. For example, in the case where the first sheet is strongly corrected and the second sheet is weekly corrected, the first sheet arrives at the finisher with a great delay but the second sheet arrives at the finisher with a little delay.

Such different timings (sheet intervals) of supplying sheets to the finisher result in the reduction of the productivity of post-printing processes in the finisher. For example, if the sheet interval is too small, paper jam tends to occur in the finisher. Conversely, if the sheet interval is too large, the waiting time of the next sheet becomes longer.

SUMMARY OF THE INVENTION

To achieve at least one of the above-mentioned objects, reflecting one aspect of the present invention, a paper correction apparatus which corrects a curl of a sheet by passing the sheet through a curved paper conveying route whose curving amount is variable, comprises: a controller which sets the curving amount of the curved paper conveying route and changes a sheet interval in accordance with the set curving amount.

Also, to achieve at least one of the above-mentioned objects, reflecting one aspect of the present invention, an image forming system comprises: the paper correction as described above; and an image forming apparatus which forms an image on a sheet, and supplies the sheet to the paper correction apparatus, wherein the image forming apparatus is provided with a sensor which detects, after forming an image on a sheet, the sheet to be discharged to the paper correction apparatus, wherein the curved paper conveying route is configured that the curving amount can be changed in a sheet interval, and wherein the controller sets the curving amount of the curved paper conveying route to correct a sheet when the sensor detects the sheet.

Furthermore, to achieve at least one of the above-mentioned objects, reflecting one aspect of the present invention, a non-transitory computer readable medium is provided on which is recorded a program which corrects a curl of a sheet by passing the sheet through a curved paper conveying route whose curving amount is variable, and makes a paper correction apparatus perform: a first step of setting the curving amount of the curved paper conveying route; and a second step of changing a sheet interval in accordance with the set curving amount.

BRIEF DESCRIPTION OF THE DRAWINGS

FIG. 5 is a conceptual representation of a table of control patterns in accordance with adjustment values.

FIG. 6 is a conceptual representation of a table of control parameters corresponding to each control pattern.

FIG. 7 is a first conceptual representation of a sheet interval control table showing the sheet interval control values for controlling the sheet interval.

FIG. 8 is a second conceptual representation of a sheet interval control table showing the sheet interval control values for controlling the sheet interval.

DETAILED DESCRIPTION OF THE PREFERRED EMBODIMENT

In what follows, several embodiments of the present invention will be explained with reference to drawings. However, the present invention is not limited to the following specific embodiments.

Figure 1:
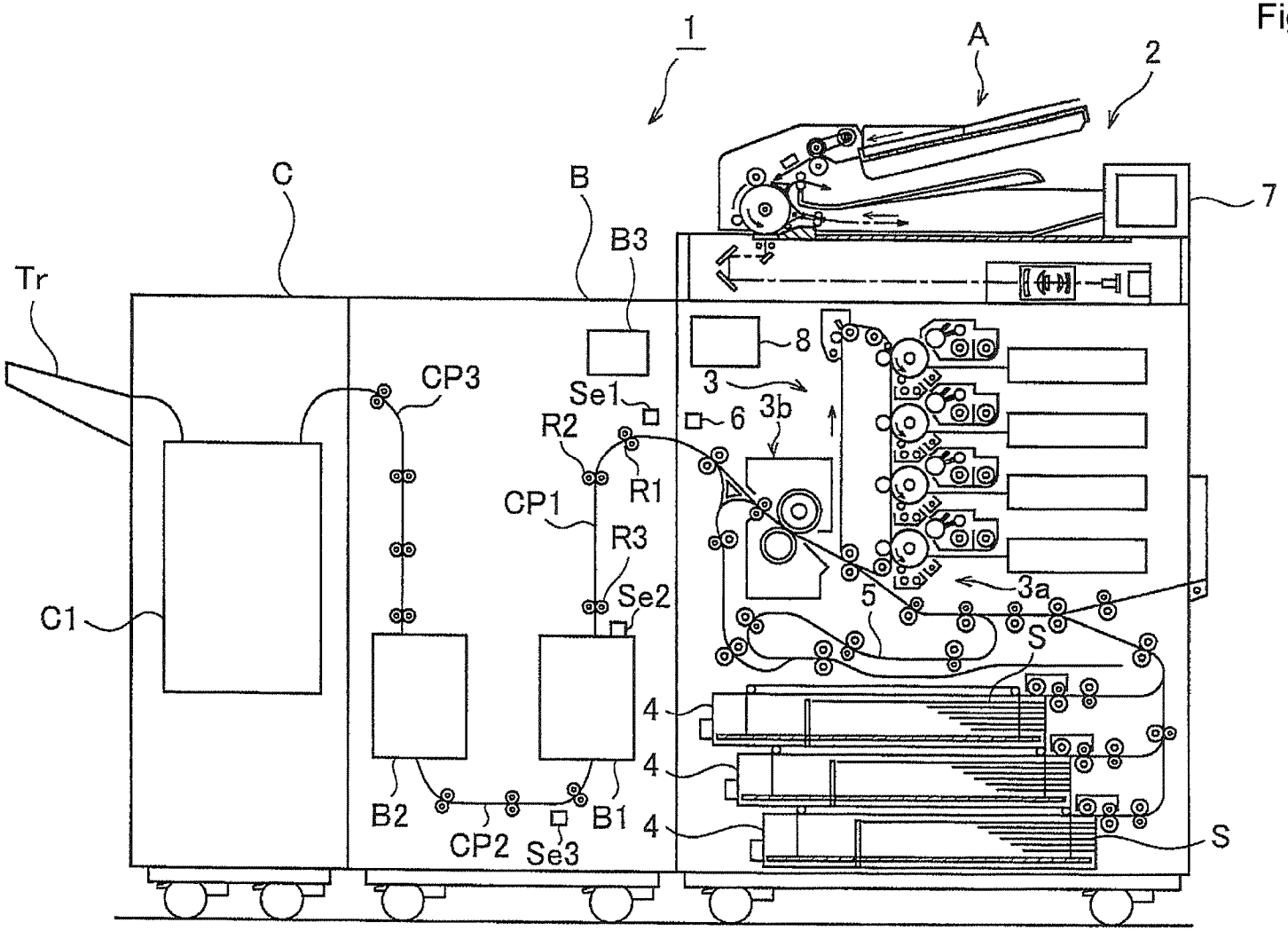
FIG. 1 is a view for schematically showing the configuration of an image forming system with a paper correction apparatus in accordance with a first embodiment.

FIG. 1 is a view for schematically showing the configuration of an image forming system with a paper correction apparatus in accordance with a first embodiment. The image forming system 1 shown in FIG. 1 includes an image forming apparatus A, a paper correction apparatus B which receives a sheet S on which an image is formed by the image forming apparatus A and corrects (i.e., decurls) a curl of the sheet S, and a finisher C which performs post-printing processes with the sheet S decurled by the paper correction apparatus B.

The image forming apparatus A is a tandem color image forming apparatus which forms an image on a sheet S, supplies the sheet S to the paper correction apparatus B, and includes a plurality of photoreceptor units vertically arranged in contact with one intermediate transfer belt to form full-color images on the sheet S. This image forming apparatus A is provided with an image reading apparatus 2 consisting of an automatic document feeder and a scanning exposing device on top thereof, and an image forming unit 3 and the plurality of paper feed trays 4 at a bottom thereof.

The image reading apparatus 2 conveys an original placed on an original tray of the automatic document feeder by a paper conveying unit, and scans and exposes images formed on both or either side of the original to read image information. Also, the image reading apparatus 2 is configured to read image information of an original which is placed on a contact glass.

The image forming unit 3 receives sheets S supplied from the plurality of paper feed tray 4, and performs an image formation process on the sheets S based on image information read by the image reading apparatus 2 or image information transmitted from a PC (Personal Computer) or the like.

This image forming unit 3 consists of an image transfer unit 3*a* and a fixing unit 3*b*. The image transfer unit 3*a* forms toner images on the photoreceptor units and transfers the toner images to a sheet S by an electrophotographic process for charging, exposing and developing. The image transfer unit 3*a* of the first embodiment is of a type having an intermediate transfer belt to which are transferred toner images from the plurality of photoreceptor units, followed by transferring the toner images from the intermediate transfer belt to a sheet S.

The fixing unit 3*b* forms a nip portion between a heat roller and a pressure roller to convey a sheet S, and heats and melts toner under pressure, while conveying the sheet S, to fix an image which is transferred to the sheet S by the image transfer unit 3*a*.

Furthermore, the image forming apparatus A is provided with the sheet reversing route 5 extending from the downstream side of the fixing unit 3*b* to the upstream side of the image transfer unit 3*a*, a discharging sensor 6 for detecting a sheet S which is discharged, an operation display panel 7 for performing various operations relating to image formation and the like, and a control unit 8.

The sheet reversing route 5 is a route for reversing the front and back sides of a sheet S and conveying the sheet S to the image transfer unit 3*a* again. This sheet reversing route 5 makes it possible to form image formation on both the front and back sides of a sheet S. The discharging sensor 6 detects a sheet S which is discharged to the paper correction apparatus B after passing through the fixing unit 3*b* which fixes an image. This discharging sensor 6 consists of a light emitting device which emits light to the sheet S, and an optical sensor which detects light reflected from the sheet S to confirm the existence of the sheet S. The operation display panel 7 is a touch panel type liquid crystal display device serving both as an operation unit and as a display unit, and can be used in this first embodiment for inputting an adjustment value which indicates the strength of curl correction (the strength of decurling force).

The control unit 8 controls the entirety of the image forming apparatus A to perform various controls of image formation, conveyance of a sheet S and so forth. Also, the control unit 8 is configured to communicate with a control unit B3 of the paper correction apparatus B.

The paper correction apparatus B is an apparatus for decurling a curl of a sheet S, which may be caused by the differential print coverage between the front and back sides of the sheet S, the differential fixing temperature between the front and back sides of the sheet S or the like, by passing the sheet S through a curved paper conveying route, the curve amount of which can be adjusted as described below (refer to CCP1 in FIG. 2 and CCP2 in FIG. 3). This paper correction apparatus B is provided with a first paper correction mechanism B1, a second paper correction mechanism B2, first to third paper conveying routes CP1 to CP3, first to third roller pairs R1 to R3, first to third sensors Se1 to Se3, and a control unit (controller) B3.

The first paper correction mechanism B1 is a mechanism unit configured to correct a curl protruding in one side direction of a sheet S, and the second paper correction mechanism B2 is a mechanism unit configured to correct a curl protruding in the other side direction of the sheet S. The paper correction mechanisms B1 and B2 include curved paper conveying routes respectively as described above.

The first paper conveying route CP1 is a route through which a sheet S is received from the image forming apparatus A and conveyed to the first paper correction mechanism B1. The second paper conveying route CP2 is a route through which the sheet S passed through the first paper correction mechanism B1 is conveyed to the second paper correction mechanism B2. The third paper conveying route CP3 is a route through which the sheet S passed through the second paper correction mechanism B2 is conveyed to the finisher C.

The first to third roller pairs R1 to R3 are roller pairs for conveying a sheet S through the first paper conveying route CP1. Of these roller pairs R1 to R3, the first and second roller pairs R1 and R2 are roller pairs for incrementing the speed of a sheet S received from the image forming apparatus A, and the third roller pair R3 is a roller pair for adjusting the speed of a sheet S introduced to the first paper correction mechanism B1. Although explanation with references is omitted here, the second and third paper conveying routes CP2 and CP3 are provided with various roller pairs respectively in the same manner as the first paper conveying route CP1.

The first to third sensors Se1 to Se3 are sensors for detecting the existence of a sheet S, and consist of optical sensors respectively. Of these sensors, the first sensor Se1 is located in the upstream side of the first paper conveying route CP1 to detect a sheet S introduced to the paper correction apparatus B. The second sensor Se2 is located just before the first paper correction mechanism B1 to detect a sheet S introduced to the first paper correction mechanism B1. The third sensor Se3 is located just after the first paper correction mechanism B1 to detect a sheet S discharged from the first paper correction mechanism B1.

The control unit B3 controls the entirety of the paper correction apparatus B by controlling the first paper correction mechanism B1, the second paper correction mechanism B2 and the first to third roller pairs R1 to R3 based on signals supplied from the control unit 8 of the image forming apparatus A and signals supplied from the first to third sensors Se1 to Se3

The finisher C is provided with a post-printing process function unit C1 which can perform processes of cutting (including punching), folding and stapling sheets S and other processes. Also, the finisher C is provided with a catch tray Tr and discharges sheets S to the catch tray Tr after the post-printing process function unit C1 performs the post-printing processes.

Next, the paper correction apparatus B will be explained in detail. FIG. 2 is a detailed view for showing the configuration of the first paper correction mechanism B1 shown in FIG. 1. As illustrated in FIG. 2, the first paper correction mechanism B1 consists of a decurl belt B11, a plurality (three) of rollers B12 to B14, a cylindrical shaft member B15, a cam mechanism B16, and a first motor M1.

The decurl belt B11 is an endless belt for conveying a sheet S and arranged to come in contact with the other side of the conveyed sheet S. This decurl belt B11 is wound around a plurality of rollers B12 to B14. One of the plurality of rollers B12 to B14 is a drive roller which rotates the decurl belt B11. The other rollers are non-driven rollers.

The cylindrical shaft member B15 is a metallic pipe which is extending in the width direction of the decurl belt B11 to come in contact with one side of the conveyed sheet S. This cylindrical shaft member B15 can either rotatably or unrotatably be supported. Also, the cylindrical shaft member B15 is configured to move in the direction intersecting the sheet conveying direction of the decurl belt B11 (more specifically, in the direction perpendicular to the conveying direction shown in FIG. 2). By such motion, it is possible to push the cylindrical shaft member B15 into the decurl belt B11 (refer to broken lines in the figure).

The paper conveying route is thereby curved by pushing the cylindrical shaft member B15 into the decurl belt B11. The curving amount of the curved paper conveying route CCP1 (the strength of the decurling force) can be determined in accordance with the pushing amount of the cylindrical shaft member B15.

Incidentally, while the pushing amount of the cylindrical shaft member B15 according to this embodiment is controlled by driving the first motor M1 to adjust the rotation of the cam mechanism B16 connected to the cylindrical shaft member B15, the present invention is not limited thereto. Also, there may further be provided another belt or the like intervening between the cylindrical shaft member B15 and the decurl belt B11.

Figure 2:
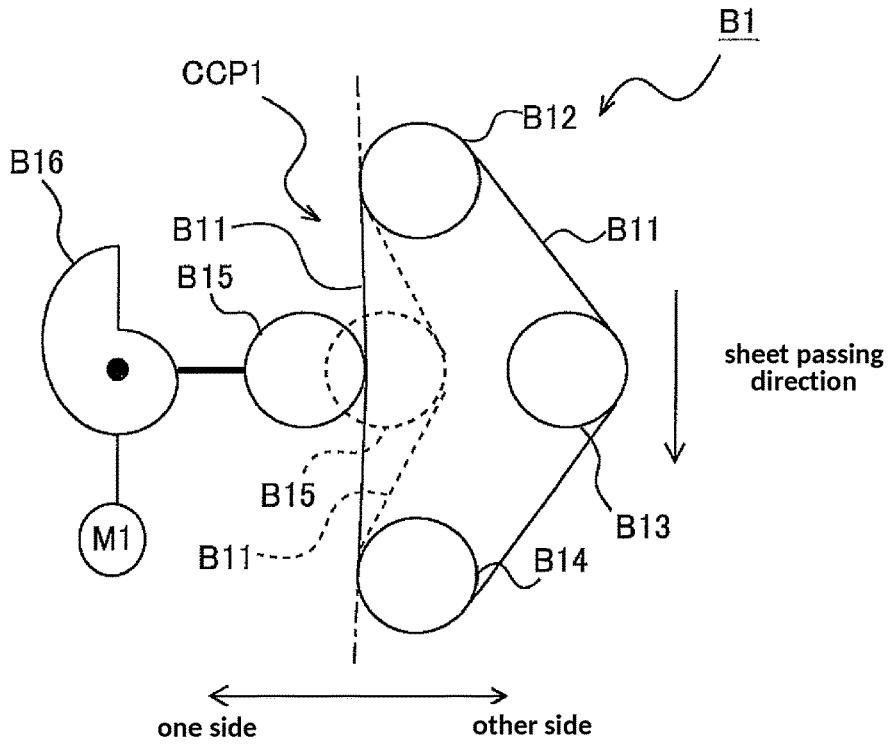
FIG. 2 is a detailed view for showing the configuration of a first paper correction mechanism shown in FIG. 1.
Figure 3:
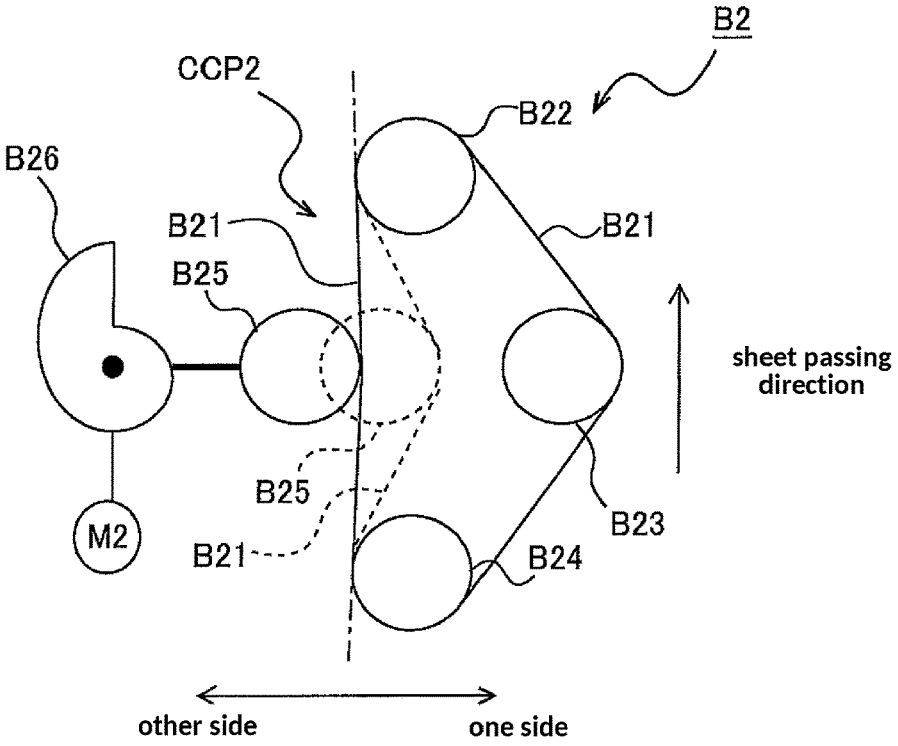
FIG. 3 is a detailed view for schematically showing the configuration of a second paper correction mechanism shown in FIG. 1.

FIG. 3 is a detailed view for schematically showing the configuration of the second paper correction mechanism B2 shown in FIG. 1. The second paper correction mechanism B2 shown in FIG. 3 has a similar configuration as the first paper correction mechanism B1 shown in FIG. 2, and includes a decurl belt B21, a plurality (three) of rollers B22 to B24, a cylindrical shaft member B25, a cam mechanism B26 and a second motor M2.

The decurl belt B21 is an endless belt for conveying a sheet S and arranged to come in contact with one side of the conveyed sheet S. This decurl belt B21 is wound around a plurality of rollers B22 to B24. One of the plurality of rollers B22 to B24 is a drive roller which rotates the decurl belt B21. The other rollers are non-driven rollers.

The cylindrical shaft member B25 is a metallic pipe which is extending in the width direction of the decurl belt B21 to come in contact with the other side of the conveyed sheet S. This cylindrical shaft member B25 can either rotatably or unrotatably be supported. Also, the cylindrical shaft member B25 is configured to move in the direction intersecting the sheet conveying direction of the decurl belt B21 (more specifically, in the direction perpendicular to the conveying direction shown in FIG. 3). By such motion, it is possible to push the cylindrical shaft member B25 into the decurl belt B21 (refer to broken lines in the figure).

The paper conveying route is thereby curved by pushing the cylindrical shaft member B25 into the decurl belt B21. The curving amount of the curved paper conveying route CCP2 (the strength of the decurling force) can be determined in accordance with the pushing amount of the cylindrical shaft member B25.

In the same manner as described above, while the pushing amount of the cylindrical shaft member B25 is controlled by driving the second motor M2 to adjust the rotation of the cam mechanism B26, the present invention is not limited thereto. Also, there may further be provided another belt or the like intervening between the cylindrical shaft member B25 and the decurl belt B21.

Figure 4:
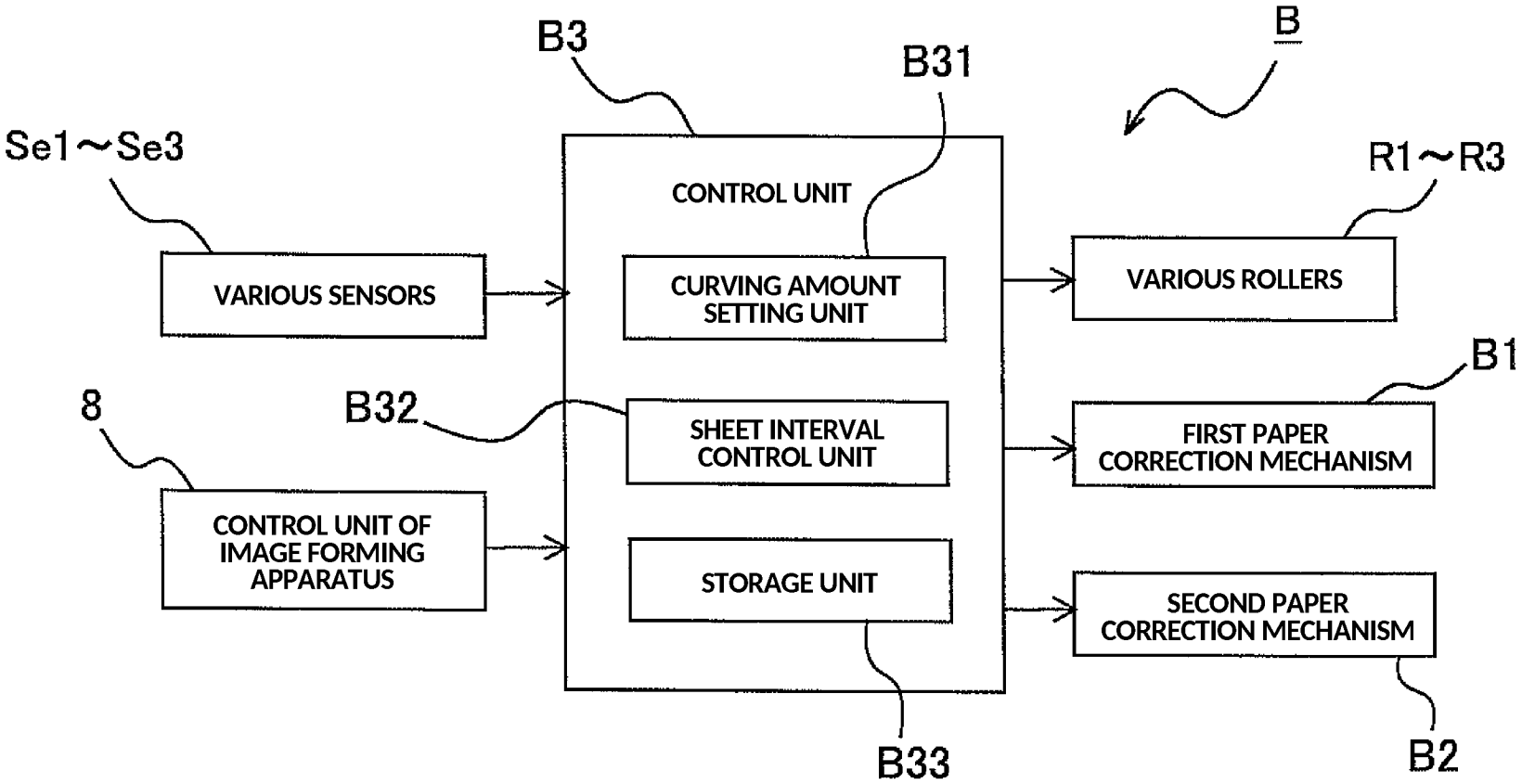
FIG. 4 is a functional block diagram for showing a control unit of the paper correction apparatus and various elements connected thereto.

FIG. 4 is a functional block diagram for showing the control unit B3 of the paper correction apparatus B and various elements connected thereto. The control unit B3 shown in FIG. 4 consists of a CPU (Central Processing Unit) and includes a storage unit (memory) B33. Also, a curving amount setting unit B31 is implemented in the control unit B3 by running a program stored in the storage unit B33.

The curving amount setting unit B31 is a function unit which sets the curving amounts of the curved paper conveying routes CCP1 and CCP2 in the first and second paper correction mechanisms B1 and B2. This curving amount setting unit B31 sets the curving amounts of the curved paper conveying routes CCP1 and CCP2 in accordance with on an adjustment value information which is input from the control unit 8 of the image forming apparatus A for decurling a sheet S.

FIG. 5 is a conceptual representation of a table of control patterns in accordance with adjustment values, and FIG. 6 is a conceptual representation of a table of control parameters corresponding to each control pattern. As shown in FIG. 5, the adjustment value is set to one of 33 levels from +16 to −16 (including 0). A user can input either one of the 33 levels of the adjustment value through the operation display panel 7 of the image forming apparatus A. The input information on the adjustment value information is transmitted to the control unit B3 of the paper correction apparatus B from the control unit 8 of the image forming apparatus A.

When information on the adjustment value is input, the curving amount setting unit B31 determines one of the control patterns "1" to "39" corresponding to the input adjustment value with reference to the control pattern table shown in FIG. 5. Furthermore, the control unit 8 of the image forming apparatus A transmits information about the type of paper and the paper density to the control unit B3 of the paper correction apparatus B. Because of this, the curving amount setting unit B31 determines the control pattern with reference to the control pattern table not only in correspondence with the adjustment value but also in correspondence with the type of paper and the paper density.

More specifically, for example, in the case where the adjustment value is +15 and the sheet is a coated paper having a paper density of 92 g/m$^2$ to 176 g/m$^2$, the curving amount setting unit B31 determines the control pattern "5" with reference to the control pattern table. Also, for example, in the case where the adjustment value is −7 and the sheet is a standard paper having a paper density of 177 g/m$^2$ to 256 g/m$^2$, the curving amount setting unit B31 determines the control pattern "25" with reference to the control pattern table.

Furthermore, after determining the control pattern, the curving amount setting unit B31 determines control parameters with reference to the control parameter table shown in FIG. 6. In the control parameter table, each control pattern is associated with an ironing angle target value (°) and a number of motor pulses (steps). Meanwhile, in FIG. 6, "1ST" stands for the first paper correction mechanism B1, and "2ND" stands for the second paper correction mechanism B2.

For example, when the control pattern "5" is determined, the curving amount setting unit B31 determines, with reference to the control parameter table, the ironing angle target value as 108° for the first paper correction mechanism B1 and 12° for the second paper correction mechanism B2. Furthermore, the curving amount setting unit B31 determines the rotation of the first motor M1 as 123 steps, and the rotation of the second motor M2 as 3 steps.

Likewise, when the control pattern "30" is determined, the curving amount setting unit B31 determines, with reference to the control parameter table, the ironing angle target value as 12° for the first paper correction mechanism B1 and 72° for the second paper correction mechanism B2. Furthermore, the curving amount setting unit B31 determines the rotation of the first motor M1 as 3 steps, and the rotation of the second motor M2 as 83 steps.

As has been discussed above, the curving amount setting unit B31 determines the control pattern based on the information about the adjustment value, the type of paper and the paper density, and determines the control parameters based on the control pattern which is determined. Also, the curving amount setting unit B31 controls the first and second motors M1 and M2 to adjust the curving amounts (ironing angle target values) of the curved paper conveying routes CCP1 and CCP2 in accordance with the control parameters which are determined as the numbers of motor pulses.

Incidentally, the curving amount setting unit B31 changes the curving amounts between two sheets S, which are successively conveyed, i.e., in an interval between the rear edge of the preceding sheet and the leading edge of the subsequent sheet. It is determined based on the signals from the sensors Se1 to Se3 and the like whether or not the curved paper conveying route is in a sheet interval.

In addition to this, the curving amount setting unit B31 sets the curving amount for a sheet S when the signal of the discharging sensor 6 is input through the control unit 8 of the image forming apparatus A, i.e., when the discharging sensor 6 detects the sheet S. For example, it is assumed that the adjustment value is −2 when the discharging sensor 6 detects the first sheet S and that the adjustment value is +15 when the discharging sensor 6 detects the first sheet S. In this case, the curving amount setting unit B31 performs control for the first sheet S based on the adjustment value −2, and performs control for the second sheet S based on the adjustment value +15.

In this case, as shown in FIG. 6 (particularly, referring to conveying length adjustment values), the conveying length of a sheet S differs depending on the curving amount in the paper correction apparatus B. Because of this, when the adjustment value is changed, the interval between sheets (sheet interval) varies, resulting in the reduction of the productivity of post-printing processes in the finisher C.

In the case of the control unit B3 according to the first embodiment, therefore, a sheet interval control unit B32 is implemented by running a program stored in the storage unit B33 as illustrated in FIG. 4. The sheet interval control unit B32 changes the sheet interval in accordance with the curving amount which is set by the curving amount setting unit B31. That is, as the curving amount of the immediately preceding sheet S becomes smaller in comparison with the curving amount of the current sheet S which is set by the curving amount setting unit B31, the sheet interval control unit B32 controls the sheet interval in order that the current sheet S is conveyed closer to the immediately preceding sheet S. Furthermore, as the curving amount of the immediately preceding sheet S becomes greater in comparison with the curving amount of the current sheet S which is set by the curving amount setting unit B31, the sheet interval control unit B32 controls the sheet interval in order that the current sheet S is conveyed more away from the immediately preceding sheet S. By this configuration, the sheet interval is controlled in order not to substantially vary while the conveying length varies in accordance with the change of the curving amount.

Particularly, the sheet interval control unit B32 of the first embodiment controls the sheet interval before a sheet S is conveyed to the curved paper conveying routes CCP1 and CCP2, i.e., when the sheet S is conveyed through the first paper conveying route CP1.

More specifically explaining, the paper correction apparatus B of the first embodiment is provided with a function of incrementing the speed of a sheet S, which is accepted, to convey the sheet S at two or more speeds after accepting the sheet S and before discharging the sheet S. The sheet interval control unit B32 controls the sheet interval by controlling the conveyance time at each of the two or more speeds. Namely, when it is desired to reduce the interval from the immediately preceding sheet S, the sheet interval control unit B32 extends the conveyance time at the higher speed of the two or more speeds, and when it is desired to expand the interval from the immediately preceding sheet S, the sheet interval control unit B32 extends the conveyance time at the lower speed of the two or more speeds.

Incidentally, the storage unit B33 consists, for example, of a semiconductor memory and stores a sheet interval control table in which the sheet interval control value for controlling the sheet interval is associated with the difference between the conveying length based on the curving amount of the current sheet which is set by the curving amount setting unit B31 and the curving amount of the immediately preceding sheet. FIG. 7 is a first conceptual representation of a sheet interval control table showing the sheet interval control values for controlling the sheet interval, and FIG. 8 is a second conceptual representation of a sheet interval control table showing the sheet interval control values for controlling the sheet interval. Incidentally, while the sheet interval control tables shown in FIG. 7 and FIG. 8 show the sheet interval control values when the control patterns 1 and 27 are switched to other control patterns, the sheet interval control tables are not limited thereto but provided for each of the 39 control patterns to show the sheet interval control value when one control pattern is switched to another control pattern.

For example, when the control pattern 1 is switched to the control pattern 6 as shown in FIG. 7, the differential conveying length between the current sheet S and the immediately preceding sheet S is −12.4 mm+0 mm=−12.4 mm. In this case, the sheet interval control value corresponding to such a differential conveying length is stored as a change amount (−α.5 seconds) of the conveyance time at the higher speed of the two or more speeds, i.e., 1600 mm/s. The sheet interval control unit B32 shortens the conveyance time at the higher speed of the two or more speeds by α5 seconds from the current conveyance time (as a result, extends the conveyance time at the lower speed) with reference to the sheet interval control table so that the sheet interval is expanded.

Also, when the control pattern 27 is switched to the control pattern 3 as shown in FIG. 8, the differential conveying length between the current sheet S and the immediately preceding sheet S is 23.5 mm−5.9 mm=17.6 mm. In this case, the sheet interval control value corresponding to such a differential conveying length is stored as a change amount (+β3 seconds) of the conveyance time at the higher speed of the two or more speeds, i.e., 1600 mm/s. The sheet interval control unit B32 extends the conveyance time at the higher speed of the two or more speeds by β3 seconds from the current conveyance time with reference to the sheet interval control table so that the sheet interval is reduced.

Meanwhile, while the sheet interval control unit B32 as described above obtains the change amount of the conveyance time at 1600 mm/s, i.e., the sheet interval control value, based on the control pattern and the sheet interval control table, the control pattern indicates the conveying length corresponding to the curving amount of a sheet S, and therefore the sheet interval control unit B32 obtains, in effect, the sheet interval control value based on the differential conveying length.

Figure 9:
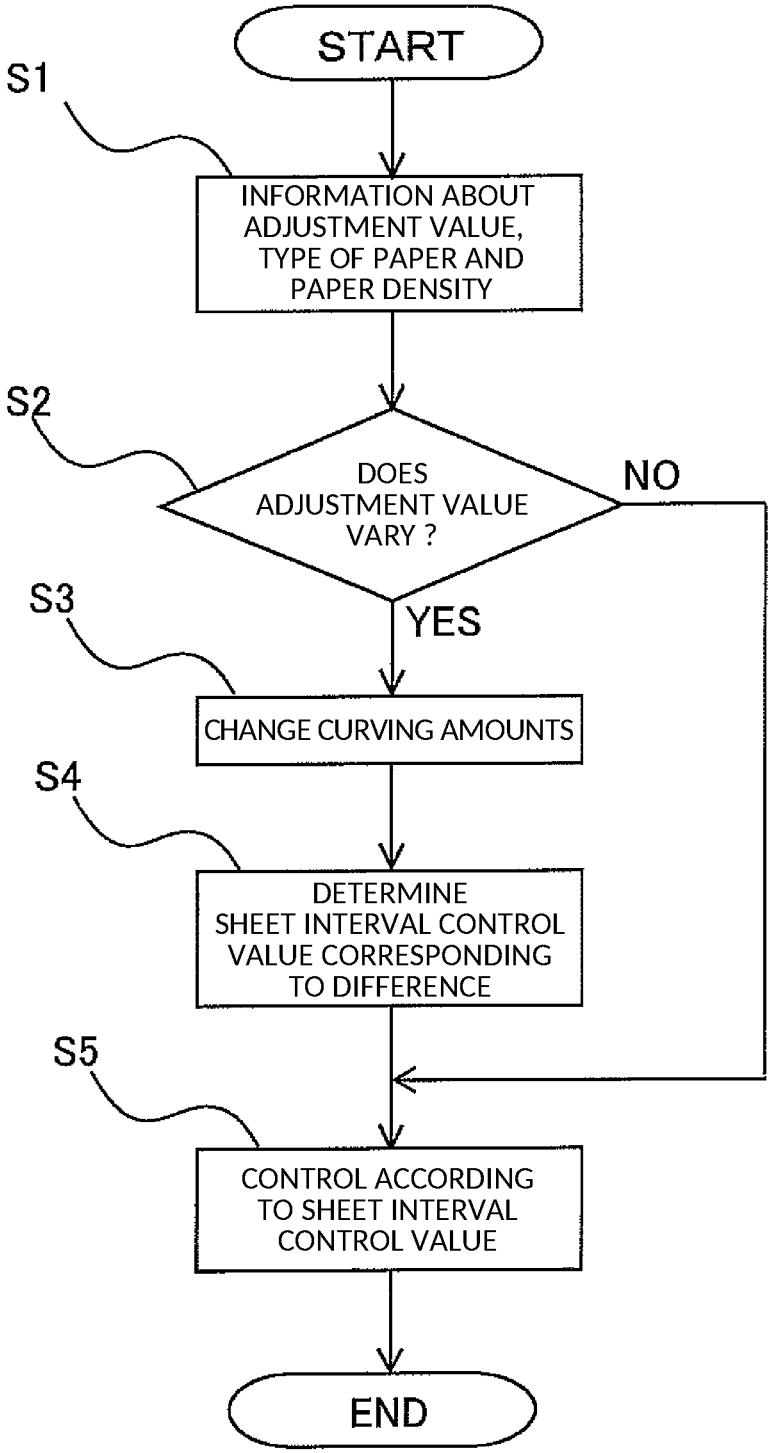
FIG. 9 is a flow chart showing a method of controlling the paper correction apparatus in accordance with the first embodiment.

Next, the control method of the paper correction apparatus B in accordance with the first embodiment will be explained. FIG. 9 is a flow chart showing the control method of the paper correction apparatus B in accordance with the first embodiment. As shown in FIG. 9, the control unit B3 of the paper correction apparatus B receives the information about the adjustment value, the type of paper and the paper density of the current sheet S (S1). Incidentally, the information about the adjustment value of the current sheet S which is input to the control unit B3 is the information about the adjustment value when the discharging sensor 6 detects the current sheet S.

Next, the control unit B3 determines whether or not there is a difference in the adjustment value between the immediately preceding sheet S and the current sheet S (S2). When there is no difference (S2: NO), since there is no difference also in the sheet interval so that the sheet interval need not be shortened or expanded, the process proceeds to step S5 in which the control based on the current sheet interval control value is continued, and the process shown in FIG. 9 is then finished.

Conversely, when there is a difference (S2: YES), the curving amount setting unit B31 changes the curving amounts of the curved paper conveying routes CCP1 and CCP2 (S3) based on the adjustment value and the like input in step S1. Furthermore, since the curving amounts of the curved paper conveying routes CCP1 and CCP2 are changed, the conveying length and the sheet interval are also changed. The sheet interval control unit B32 thereby performs control operations in order to eliminate the change of the sheet interval. In this case, the sheet interval control unit B32 applies, to the sheet interval control table, the difference between the conveying length based on the adjustment value of the immediately preceding sheet S (the conveying length based on the curving amount) and the conveying length based on the adjustment value of the current sheet S (the conveying length based on the curving amount) to determine the sheet interval control value corresponding to the differential conveying length (S4). The sheet interval control value of the first embodiment is the conveyance time at 1600 mm/s.

Next, the sheet interval control unit B32 performs control operations (S5) in accordance with the sheet interval control value which is determined in step S4. The process shown in FIG. 9 is then finished.

Figure 10:
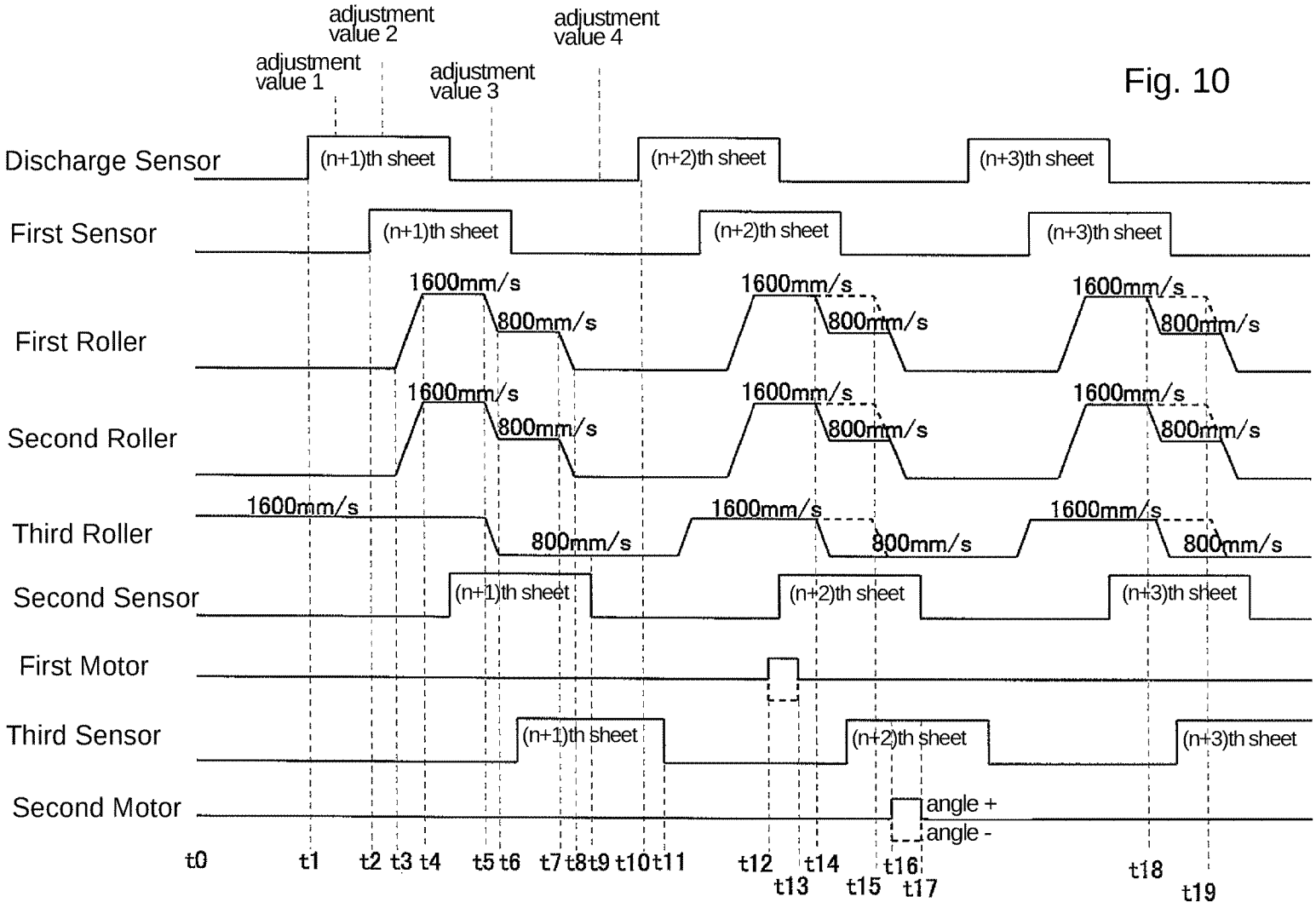
FIG. 10 is a timing chart showing a method of controlling the paper correction apparatus in accordance with the first embodiment.

FIG. 10 is a timing chart showing the control method of the paper correction apparatus B in accordance with the first embodiment. It is assumed here that image formation has been finished, and that the adjustment value is "0" at time t0. It is also assumed that the discharging sensor 6 detects the (n+1)-th sheet S at time t1, and that the first sensor Se1 detects the (n+1)-th sheet S at time t2.

The first to third roller pairs R1 to R3 conveys the sheet S at the two or more speeds respectively. Specifically, the rotational speeds of the first and second roller pairs R1 and R2 are increased at time t3 to increment the speed of a sheet S introduced to the paper correction apparatus B. The sheet conveying speeds of the first and second roller pairs R1 and R2 reach, for example, 1600 mm/s at time t4. Incidentally, for example, the sheet conveying speed is 460 mm/s, 630 mm/s or the like before time t3.

The sheet conveying speeds of the first and second rollers R1 and R2 are maintained at 1600 mm/s before time t5, starts to decrease at time t5, reaches 800 mm/s at time t6, starts to decrease again at time t7, and reaches 460 mm/s, 630 mm/s or the like.

Namely, after receiving a sheet S at the conveying speed of 460 mm/s or 630 mm/s, the first and second rollers R1 and R2 are accelerated to the conveying speed of 1600 mm/s, and then decelerated to the conveying speed of 460 mm/s or 630 mm/s again for waiting for the next sheet S to arrive.

Also, the conveying speed of the third roller R3 is 1600 mm/s before time t5, starts to decrease at time t5, and reaches 800 mm/s at time t6. In this case, the conveying speed of a sheet S in the first paper correction mechanism B1 is 800 mm/s. The conveying speed of the third roller R3 is decreased to 800 mm/s at time t9 when the second sensor Se2 no longer detects a sheet S so that the sheet S can smoothly be conveyed to the first paper correction mechanism B1.

Then, the (n+1)-th sheet S is discharged from the first paper correction mechanism B1, detected by the third sensor Se3, passed through the second paper correction mechanism B2 and discharged to the finisher C.

It is assumed that, while the sheet conveying operation is performed in this manner, the adjustment value is incremented from "0", and increased to "4" when the discharging sensor 6 detects the (n+2)-th sheet S at time t10.

In this case, the curving amount setting unit B31 changes the curving amounts of the curved paper conveying routes CCP1 and CCP2 in accordance with the adjustment value which is changed from "0" to "4". Namely, the curving amount setting unit B31 determines a sheet interval in accordance with the elapsed time from time t9 when the (n+1)-th sheet S stopped being detected by the second sensor Se2, and starts to drive the first motor M1 at time t12 which is determined as being within the sheet interval. Incidentally, while the second sensor Se2 detects the (n+2)-th sheet S at time t13 when the first motor M1 stops operation, the curving amount of the curved paper conveying route CCP1 can be changed in the sheet interval because there is an interval between the second sensor Se2 and the curved paper conveying route CCP1.

In the same manner as described above, the curving amount setting unit B31 determines a sheet interval in accordance with the elapsed time from time t11 when the (n+1)-th sheet S stopped being detected by the third sensor Se3, and starts to drive the second motor M2 at time t16 which is determined as being within the sheet interval. Incidentally, while the third sensor Se3 detects the (n+2)-th sheet S at time t16 when the second motor M2 starts operation and at time t17 when the second motor M2 stops operation, the curving amount of the curved paper conveying route CCP2 can be changed in the sheet interval because there is an interval between the third sensor Se3 and the curved paper conveying route CCP2.

Furthermore, the sheet interval control unit B32 determines the sheet interval control value in accordance with the adjustment value which is changed from "0" to "4", and performs control operations based on the determined sheet interval control value. In this case, the sheet interval control unit B32 extends the conveyance time at the conveying speed of 1600 mm/s.

For example, while the conveying speeds of the first to third roller pairs R1 to R3 are decreased from time t14 if the adjustment value is "0", the sheet interval control unit B32 shifts the time, at which the conveying speed starts to decrease, from time t14 to time t15 as illustrated with broken lines. By this control, the conveyance time of the conveying speed at 1600 mm/s is extended to inhibit the sheet interval from varying due to variation of the conveying length.

Meanwhile, since the conveyance time at 1600 mm/s is extended for the (n+2)-th sheet S, the sheet interval control unit B32 extends the conveyance time at 1600 mm/s also for the (n+3)-th sheet S from time t18 to time t19. This is true also for the (n+4)-th and subsequent sheets.

As has been discussed above, in accordance with the paper correction apparatus B of the first embodiment, since the curving amounts of the curved paper conveying routes CCP1 and CCP2 are set and the sheet interval is changed corresponding to the set curving amounts, it is possible to prevent the sheet interval from being too long or too short due to different conveying lengths of sheets and inhibit the productivity from being reduced due to paper correction.

Also, since the sheet interval is changed by controlling the conveyance times at the two or more speeds at which a sheet S is conveyed after the sheet S is introduced to the paper correction apparatus B and before the sheet S is discharged from the paper correction apparatus B, it is possible to prevent the sheet interval from being too long or too short by adjusting the conveyance time at each of the two or more speeds and inhibit the productivity from being reduced due to paper correction.

Furthermore, before a sheet S is conveyed to the curved paper conveying routes CCP1 and CCP2, the sheet interval between this sheet S and the immediately preceding sheet S is changed. In the case of the paper correction apparatus B provided with the rollers R1 and R2 which increment the conveying speed of the sheet S introduced from the image forming apparatus A, thereby, the sheet interval can be changed by making use of the existing configuration, i.e., by adjusting the control of the rollers R1 and R2.

In the case of the conventional technique described in Japanese Patent Published Application No. 2013-28434, the paper feed timing is adjusted by measuring a sheet interval in order that a sheet arrives at a paper stop roller with an appropriate timing. If this technique is used in the paper correction apparatus B, the sheet interval has to be measured so that the technique is implemented in the subsequent stage of the second paper correction mechanism B2. In this case, there have to be provided anew, in the subsequent stage, a sensor for measuring the sheet interval and a mechanism for adjusting the timing of discharging a sheet, and therefore the paper conveying route becomes longer to increase a device size. These shortcomings are prevented in the case of this embodiment.

Also, as the curving amount of the immediately preceding sheet S becomes smaller in relation to the curving amount of the current sheet S, the sheet interval is controlled in order that the current sheet S comes nearer to the immediately preceding sheet S. On the other hand, as the curving amount of the immediately preceding sheet S becomes larger in relation to the curving amount of the current sheet S, the sheet interval is controlled in order that the current sheet S is more remote from the immediately preceding sheet S. The sheet interval can thereby be controlled by taking into consideration the differential curving amount from the immediately preceding sheet S.

Furthermore, the sheet interval is controlled based on the difference between the conveying length corresponding to the curving amount of the current sheet S and the conveying length corresponding to the curving amount of the immediately preceding sheet S and based on the sheet interval control value which is obtained with reference to the sheet interval control table, and therefore it is possible to control the sheet interval in a simple and appropriate way without requiring complicated calculation.

Still further, in accordance with the image forming system 1 of the first embodiment, since the curving amounts of the curved paper conveying routes CCP1 and CCP2 are set for correcting a sheet S when the sheet S is detected by the discharging sensor 6 configured to detect a sheet which is discharged to the paper correction apparatus B, the settings of the curving amounts are not suddenly changed during conveying the sheet S in the paper correction apparatus B, and the curving amounts can be set with an appropriate timing. Still further, since the curving amounts of the curved paper conveying routes CCP1 and CCP2 can be changed in a sheet interval, it is possible to prevent the curving amount from being changed while no sheet S is conveyed in the curved paper conveying routes CCP1 and CCP2 to occur troubles in paper correction.

Next, a second embodiment of the present invention will be explained. The paper correction apparatus B and the image forming system 1 of the second embodiment are similar to those of the first embodiment except for some differences therebetween in the control method. In what follows, the differences from the first embodiment will be explained.

Figure 11:
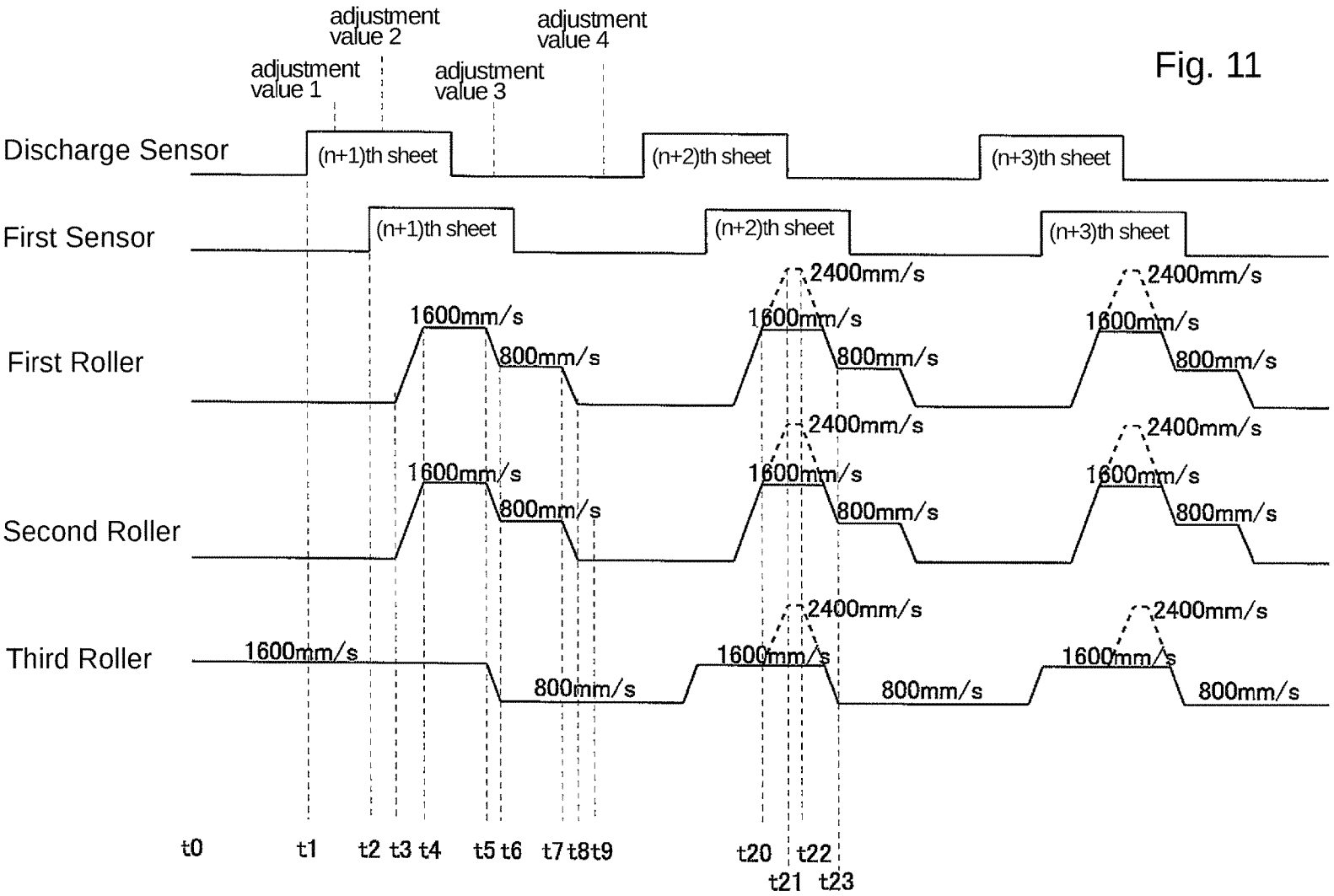
FIG. 11 is a timing chart showing a method of controlling the paper correction apparatus in accordance with a second embodiment.

FIG. 11 is a timing chart showing the control method of the paper correction apparatus B in accordance with the second embodiment. Meanwhile, in the timing chart of FIG. 11, the first and second motors M1 and M2 and the like are omitted.

First, the processes from time 0 to time t9 are the same as in the first embodiment. Furthermore, the operations of the curving amount setting unit B31, i.e., the operations of the first and second motors M1 and M2 are also the same as in the first embodiment.

In the case of the sheet interval control unit B32 according to the second embodiment, the sheet interval is changed by introducing, in addition to the sheet conveying speeds, a new different sheet conveying speed for conveying a sheet S after the sheet S is introduced to the paper correction apparatus B and before the sheet S is discharged from the paper correction apparatus B.

Specifically, the sheet interval control unit B32 makes use of 2400 mm/s as a new sheet conveying speed for conveying a sheet S to change the sheet interval. Namely, the sheet interval control unit B32 increments the conveying speeds of the first to third roller pairs R1 to R3 respectively even after time t20 so that the conveying speeds reach 2400 mm/s at time t21. Thereafter, the sheet interval control unit B32 maintains the sheet conveying speed at 2400 mm/s for a predetermined period, and starts to decrease the sheet conveying speed at time t22. The sheet interval control unit B32 decreases the conveying speeds of the first to third roller pairs R1 to R3 respectively to 800 mm/s at time t23.

Meanwhile, in order to perform such control, the storage unit B33 stores a sheet interval control table containing the new sheet conveying speed as a sheet interval control value.

Like the first embodiment, in accordance with the paper correction apparatus B of the second embodiment, it is possible to inhibit the productivity from being reduced due to paper correction, and change the sheet interval by making use of the existing configuration, i.e., by adjusting the control of the rollers R1 and R2. Also, it is possible to avoid the shortcoming that there have to be provided anew, in the subsequent stage, a sensor for measuring the sheet interval and a mechanism for adjusting the timing of discharging a sheet to elongate the paper conveying route and increase a device size. Furthermore, since the sheet interval can be controlled by taking into consideration the differential curving amount from the immediately preceding sheet S based on the sheet interval control value which is obtained from the differential conveying length with reference to the sheet interval control table, it is possible to control the sheet interval in a simple and appropriate way without requiring complicated calculation. Still further, in accordance with the second embodiment, like the first embodiment, the curving amounts can be set with an appropriate timing to prevent troubles from occurring in paper correction.

Still further, in accordance with the second embodiment, the sheet interval is changed by introducing, in addition to the sheet conveying speeds, a new different sheet conveying speed for conveying a sheet S after the sheet S is introduced to the paper correction apparatus B and before the sheet S is discharged from the paper correction apparatus B, and thereby it is possible to prevent the sheet interval from being too long or too short due to different conveying lengths of sheets, for example, by increasing and decreasing the sheet conveying speed in a route where a sheet S is conveyed at a certain base speed, and inhibit the productivity from being reduced due to paper correction.

Next, a third embodiment of the present invention will be explained. The paper correction apparatus B and the image forming system 1 of the third embodiment are similar to those of the first embodiment except for some differences therebetween in the configuration and the control method. In what follows, the differences from the first embodiment will be explained.

Figure 12:
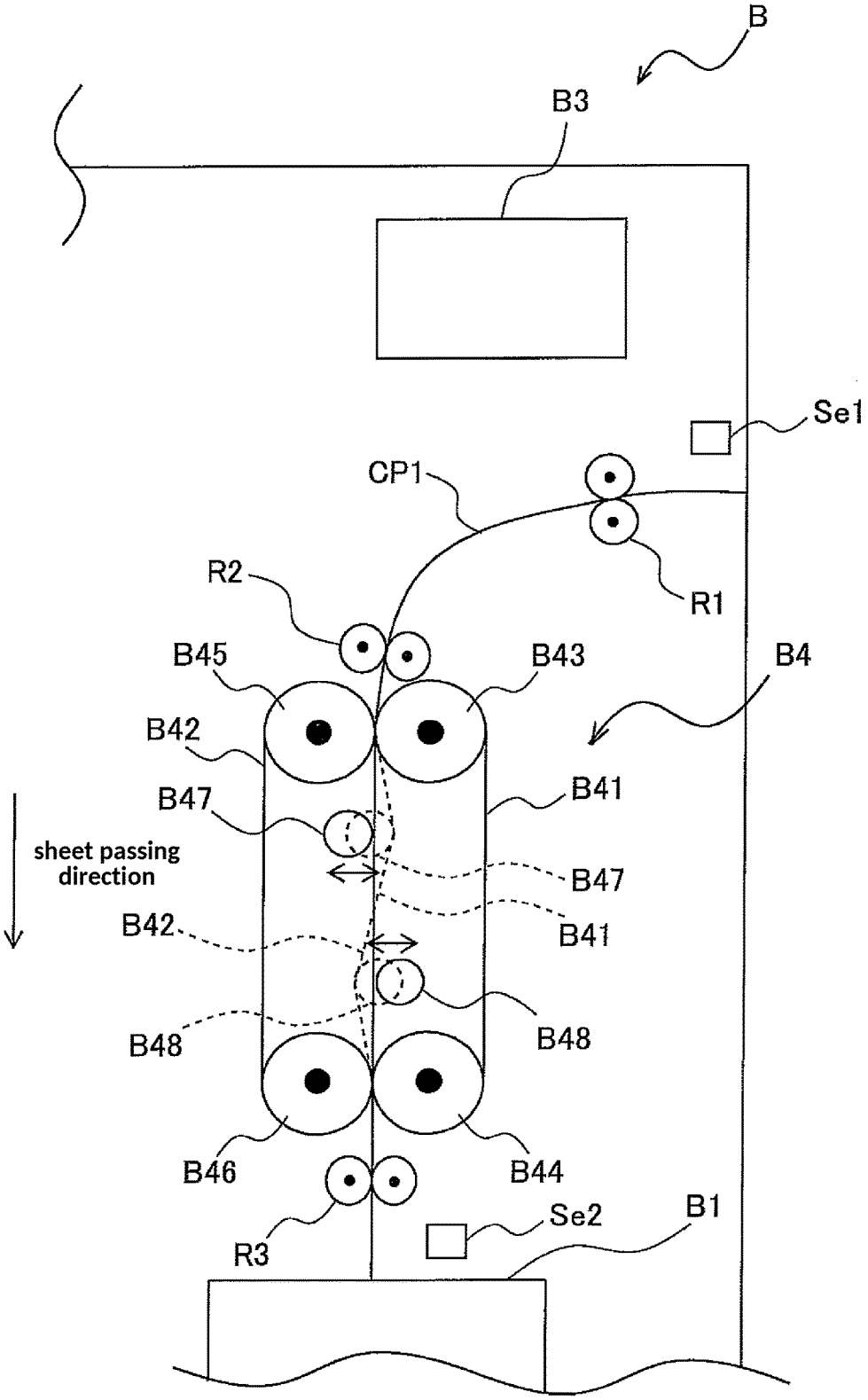
FIG. 12 is a view for schematically showing the configuration of a paper correction apparatus in accordance with a third embodiment.

FIG. 12 is a view for schematically showing the configuration of the paper correction apparatus B in accordance with the third embodiment. The paper correction apparatus B in accordance with the third embodiment is provided further with a conveying length adjustment mechanism B4. The conveying length adjustment mechanism B4 controls the length of the paper conveying route after a sheet S is introduced to the paper correction apparatus B and before the sheet S is discharged from the paper correction apparatus B. In this third embodiment, the sheet interval is controlled by controlling the conveying length adjustment mechanism B4. Meanwhile, in accordance with this example, the conveying length adjustment mechanism B4 is located on the first paper conveying route CP1. However, it is not limited to this location, but the conveying length adjustment mechanism B4 can be located on either one of the second and third paper conveying routes CP2 and CP3.

The conveying length adjustment mechanism B4 is provided with two endless belts B41 and B42, a plurality (four) of rollers B43 to B46, and two cylindrical shaft members B47 and B48. The first endless belt B41 is wound around the two rollers B43 and B44. One of the two rollers B43 and B44 is a drive roller, and other is a non-driven wheel. Likewise, the second endless belt B42 is wound around the two rollers B45 and B46. Also, one of the two rollers B45 and B46 is a drive roller, and other is a non-driven wheel.

The first endless belt B41 and the second endless belt B42 are arranged to be in contact with each other at part of their belt surfaces in order that a sheet S can be held and conveyed therebetween when the above drive rollers are driven to rotate.

The first cylindrical shaft member B47 is the similar member as the cylindrical shaft members B15 and B25, and arranged inside the second endless belt B42. This first cylindrical shaft member B47 is configured to move in the direction intersecting the sheet conveying direction (more specifically, in the direction perpendicular to the conveying direction shown in FIG. 12). By such motion, the first cylindrical shaft member B47 can be pushed into the first endless belt B41 and the second endless belt B42 (refer to broken lines in the figure).

The second cylindrical shaft member B48 is also the similar member as the cylindrical shaft members B15 and B25. This second cylindrical shaft member B48 is arranged inside the first endless belt B41. The first cylindrical shaft member B47 and the second cylindrical shaft member B48 are arranged displaced from each other in the sheet conveying direction. Also, this second cylindrical shaft member B48 is configured to move in the direction intersecting the sheet conveying direction (more specifically, in the direction perpendicular to the conveying direction shown in FIG. 12). Like the first cylindrical shaft member B47, the second cylindrical shaft member B48 can be pushed into the first endless belt B41 and the second endless belt B42 (refer to broken lines in the figure).

The motions of these two cylindrical shaft members B47 and B48 can be controlled in the same manner as illustrated in FIG. 2 and FIG. 3 in which the motors M1 and M2 are controlled.

Furthermore, in order to control the above structure, the storage unit B33 of the third embodiment stores a sheet interval control table containing the moving amounts of the two cylindrical shaft members B47 and B48 (rotating amounts of motors) as sheet interval control values. With reference to the sheet interval control table, the moving amounts of the two cylindrical shaft members B47 and B48 (rotating amounts of motors) is determined and controlled in accordance with the change to the adjustment value indicative of the strength of the decurling force.

Like the first embodiment, in accordance with the paper correction apparatus B of the third embodiment, it is possible to inhibit the productivity from being reduced due to paper correction, and avoid the shortcoming that there have to be provided anew, in the subsequent stage, a sensor for measuring the sheet interval and a mechanism for adjusting the timing of discharging a sheet to elongate the paper conveying route and increase a device size. Furthermore, since the sheet interval can be controlled by taking into consideration the differential curving amount from the immediately preceding sheet S based on the sheet interval control value which is obtained from the differential conveying length with reference to the sheet interval control table, it is possible to control the sheet interval in a simple and appropriate way without requiring complicated calculation. Still further, in accordance with the third embodiment, like the first embodiment, the curving amounts can be set with an appropriate timing to prevent troubles from occurring in paper correction.

Furthermore, in accordance with the third embodiment, since the sheet interval is changed by adjusting the conveying length through the paper conveying routes CP1 to CP3 except the curved paper conveying routes CCP1 and CCP2 in order to cancel the differential conveying length between sheets S due to the curved paper conveying routes CCP1 and CCP2, it is possible to prevent the sheet interval from being too long or too short and inhibit the productivity from being reduced due to paper correction.

In addition, when the sheet interval between the current sheet S and the immediately preceding sheet S is changed before the current sheet S is conveyed to the curved paper conveying routes CCP1 and CCP2, for example, when the conveying length of the first paper conveying route CP1 is controlled by forming a curved route in the first paper conveying route CP1, even if the current sheet S is curled by this curved route, this curled sheet can also be corrected by the curved paper conveying routes CCP1 and CCP2 in the subsequent stage to reduce possibility of failure in appropriately correcting the sheet S due to adjustment of the sheet interval.

The paper correction apparatus and the image forming system have been explained based on the embodiments in accordance with the present invention. However, it is not intended to limit the present invention to the precise form described, and obviously many modifications and variations are possible without departing from the scope of the invention. Also, if possible, the techniques of the embodiments can be combined as well as known techniques and the like.

For example, while the cylindrical shaft members B15, B25, B47 and B48 are configured to move in the perpendicular direction in the case of the above embodiments, the configuration is not limited thereto, but these members can be configured to move in a somewhat oblique direction as long as these members is in contact with and pushed into the belts B11, B21, B41 and B42.

Also, while the sheet interval is controlled always in the first paper conveying route CP1 in the case of the above embodiments, the present invention is not limited thereto, but the sheet interval can be controlled in either of the second and third paper conveying routes CP2 and CP3. Particularly, in the case where the sheet interval between the current sheet S and the immediately preceding sheet S is changed before the current sheet S is conveyed to the two curved paper conveying routes CCP1 and CCP2 or after the current sheet S is discharged from the two curved paper conveying routes CCP1 and CCP2, it is avoided that the quality of paper correction is affected by control of changing the sheet conveying speed in the paper correction mechanisms B1 and B2 while a sheet S is conveyed through the curved paper conveying routes CCP1 and CCP2.

Incidentally, while the sheet conveying speed in the paper correction mechanisms B1 and B2 is preferably a fixed speed, the present invention is not limited thereto, but the sheet conveying speed in the paper correction mechanisms B1 and B2 can be variable to control the sheet interval.

In addition, while the sheet interval control table is provided in the case of the above embodiment, the present invention is not limited thereto, but a calculation formula can be used in place of the table. For example, while a value of variable La is obtained by a calculation formula, i.e., La=(30.8 mm−(the conveying length adjustment value of the first curved paper conveying route)+(the conveying length adjustment value of the second curved paper conveying route))/C, the sheet interval control table need not be provided by shortening the conveyance time at 1600 mm/s as La increases. In this formula, C is a constant.

Also, while the paper correction apparatuses B of the above embodiments are connected in the downstream side of the image forming apparatus A, the present invention is not limited to this, but applicable to an offline finisher which is not connected to the image forming apparatus A but capable of performing post-printing processes alone with a sheet S after image formation.

Furthermore, while a curving amount is set by determining a control pattern in accordance with an input adjustment value in the case of the above embodiments, the present invention is not limited to this, but the control unit B3 of the paper correction apparatus B can set a curving amount to correct a curl of a sheet S by determining the curling amount of the sheet S with reference to at least one of the differential print coverage between the front and back sides of the sheet S, the differential fixing temperature between the front and back sides of the sheet S, and whether or not humidification is performed only to one side of the sheet S.

Still further, while the program implemented in the paper correction apparatus B of the above embodiments is stored in the storage unit B33 of the control unit B3, the present invention is not limited to this, but the program can be stored in a hard disk drive, a DVD-ROM (Digital Versatile Disc-Read Only Memory), a CD-ROM (Compact Disc-Read Only Memory), a blue ray disk or the like, from which the program is loaded onto the paper correction apparatus B.

What is claimed is:

1. A paper correction apparatus which corrects a curl of a sheet by passing the sheet through a curved paper conveying route whose curving amount is variable, comprising:

a paper correction mechanism comprising an endless belt for conveying the sheet, a plurality of rollers, and a shaft, wherein the endless belt provides the curved paper conveying route and the shaft is configured to provide the curving amount of the curved paper conveying route;

a plurality of roller pairs configured to convey the sheet; and a controller which sets the curving amount of the curved paper conveying route and increases or decreases a sheet interval in accordance with the set curving amount;

wherein the sheet interval is changed by controlling the plurality of roller pairs to change a conveying speed of the sheet; and the plurality of roller pairs is provided upstream of the paper correction mechanism or downstream of the paper correction mechanism.

2. The paper correction apparatus of claim 1 wherein the sheet is conveyed at two or more speeds by at least one roller pair of the plurality of roller pairs after the sheet is introduced to the paper correction apparatus and before the sheet is discharged from the paper correction apparatus, and the controller changes the sheet interval by controlling a conveyance time at each of the two or more speeds.

3. The paper correction apparatus of claim 2 wherein the controller increases or decreases the sheet interval by introducing a third sheet conveying speed to the at least one roller pair for conveying a sheet after the sheet is introduced to the paper correction apparatus and before the sheet is discharged from the paper correction apparatus.

4. The paper correction apparatus of claim 1, wherein the controller increases or decreases the sheet interval by adjusting the conveying speed through the paper conveying route, and not adjust the conveying speed through the curved paper conveying route.

5. The paper correction apparatus of claim 1 wherein before a current sheet is conveyed to the curved paper conveying route or after the current sheet is discharged from the curved paper conveying route, the controller changes the set curving amount of the curved paper conveying route in order to increase or decrease the sheet interval between the current sheet and a sheet immediately preceding the current sheet.

6. The paper correction apparatus of claim 5 wherein before the current sheet is conveyed to the curved paper conveying route, the controller changes the set curving amount of the curved paper conveying route in order to increase or decrease the sheet interval between the current sheet and a sheet immediately preceding the current sheet.

7. The paper correction apparatus of claim 1 wherein the controller decreases the sheet interval when a sensor detects that a current sheet has a curving amount which is smaller than a curving amount of an immediately preceding sheet, and the controller increases the sheet interval when the current sheet has a curving amount which is larger in relation to the curving amount of the immediately preceding sheet.

8. The paper correction apparatus of claim 7 wherein the controller comprises a memory to store a sheet interval control table in which a sheet interval control value for controlling the sheet interval is associated with a difference between the conveying length corresponding to the curving amount of the current sheet and the conveying length corresponding to the curving amount of the immediately preceding sheet, and wherein the controller increases or decreases the sheet interval based on the difference and the sheet interval control value which is obtained with reference to the sheet interval control table.

9. An image forming system comprising:

the paper correction apparatus as recited in claim 1; and an image forming apparatus which forms an image on a sheet, and supplies the sheet to the paper correction apparatus, wherein the image forming apparatus is provided with a sensor which detects, after forming an image on a sheet, the sheet to be discharged to the paper correction apparatus, wherein the curved paper conveying route is configured that the curving amount can be changed in a sheet interval, and wherein the controller sets the curving amount of the curved paper conveying route to correct a sheet when the sensor detects the sheet.

10. A non-transitory computer readable medium on which is recorded a program which corrects a curl of a sheet by passing the sheet through a curved paper conveying route whose curving amount is variable, and makes a paper correction apparatus perform:

a first step comprising setting a curving amount of the curved paper conveying route; and a second step comprising increasing or decreasing a sheet interval in accordance with the set curving amount, wherein the paper correction apparatus comprises a paper correction mechanism comprising an endless belt for conveying the sheet through the paper correction mechanism and a cylindrical shaft, wherein the endless belt provides the curved paper conveying route and the cylindrical shaft is configured to provide the curving amount of the curved paper conveying route; a plurality of roller pairs configured to convey the sheet;

wherein the sheet interval is changed by controlling the plurality of roller pairs to change the conveying speed of the sheet; and the plurality of roller pairs is provided upstream of the paper correction mechanism or downstream of the paper correction mechanism.

11. The non-transitory computer readable medium of claim 10 wherein in the case where a sheet is conveyed at two or more speeds by at least one roller pair of the plurality of roller pairs after the sheet is introduced to the paper correction apparatus and before the sheet is discharged from the paper correction apparatus, the sheet interval is increased or decreased in the second step by controlling a conveyance time at the two or more speeds.

12. The non-transitory computer readable medium of claim 11 wherein the sheet interval is increased or decreased in the second step by introducing a third sheet conveying speed to the at least one roller pair for conveying a sheet after the sheet is introduced to the paper correction apparatus and before the sheet is discharged from the paper correction apparatus.

13. The non-transitory computer readable medium of claim 10 wherein the plurality of roller pairs are configured to provide a plurality of paper conveying routes after the sheet is introduced to the paper correction apparatus and before the sheet is discharged from the paper correction apparatus, and wherein the sheet interval is increased or decreased in the second step by adjusting the conveying speed through one of the paper conveying routes, and not adjust the conveying speed through the curved paper conveying route.

14. The non-transitory computer readable medium of claim 10 wherein before a current sheet is conveyed to the curved paper conveying route or after the current sheet is discharged from the curved paper conveying route, the sheet interval is increased or decreased in the second step between the current sheet and a sheet immediately preceding the current sheet.

15. The non-transitory computer readable medium of claim 14 wherein before the current sheet is conveyed to the curved paper conveying route, the sheet interval is increased or decreased in the second step between the current sheet and the sheet immediately preceding the current sheet.

16. The non-transitory computer readable medium of claim 10 wherein the sheet interval is decreased in the second step when a sensor detects that a current sheet has a curving amount which is smaller than a curving amount of a sheet immediately preceding the current sheet, and the sheet interval is increased in the second step when the current sheet has a curving amount which is greater than the curving amount of the immediately preceding sheet.

17. The non-transitory computer readable medium of claim 16 wherein the sheet interval is increased or decreased in the second step based on a difference between the conveying length corresponding to the curving amount of the current sheet and the conveying length corresponding to the curving amount of the immediately preceding sheet, and a sheet interval control value for controlling the sheet interval which is obtained with reference to a sheet interval control table in which the sheet interval control value is associated with the difference.

* * * * *